US006766667B2

(12) United States Patent
Dohtsu et al.

(10) Patent No.: US 6,766,667 B2
(45) Date of Patent: Jul. 27, 2004

(54) KNITTED FABRIC HAVING OPEN PART AND KNITTING METHOD THEREFOR

(75) Inventors: Masahiro Dohtsu, Wakayama (JP); Masao Okuno, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/469,581

(22) PCT Filed: Feb. 28, 2002

(86) PCT No.: PCT/JP02/01886

§ 371 (c)(1),
(2), (4) Date: Sep. 2, 2003

(87) PCT Pub. No.: WO02/070800

PCT Pub. Date: Sep. 12, 2002

(65) Prior Publication Data

US 2004/0093907 A1 May 20, 2004

(30) Foreign Application Priority Data

Mar. 2, 2001 (JP) ..... 2001-058130
Apr. 20, 2001 (JP) ..... 2001-123233

(51) Int. Cl.[7] ..... D04B 7/30
(52) U.S. Cl. ..... 66/69; 66/176
(58) Field of Search ..... 66/60 R, 64, 68, 66/70, 71, 69, 169 R, 170, 171, 172 R, 175, 176, 75.1

(56) References Cited

U.S. PATENT DOCUMENTS 3,640,097 A * 2/1972 Bett et al. ..... 66/176
5,417,088 A * 5/1995 Nakai ..... 66/76
5,584,197 A * 12/1996 Okuno ..... 66/64
5,956,975 A * 9/1999 Kawashima ..... 66/64
6,138,482 A 10/2000 Shimasaki et al.
6,550,284 B2 * 4/2003 Okamoto ..... 66/176

FOREIGN PATENT DOCUMENTS

| | | |
|---|---|---|
| JP | 8-113853 A | 5/1996 |
| JP | 10-140446 A | 5/1998 |
| JP | 2000-256946 A | 9/2000 |
| WO | WO01/063030 A1 | 8/2001 |

* cited by examiner

*Primary Examiner*—Larry D Worrell, Jr.
(74) *Attorney, Agent, or Firm*—Rothwell, Figg, Ernst & Manbeck, P.C.

(57) ABSTRACT

The present invention aims to provide improved texture of right and left marginal parts formed to extend along an open part of knitwear knitted in a tubular form, such as a cardigan and a vest with open part. The invention provide a method for producing a tubular fabric wherein a vertically extending open part (2) is formed and right and left marginal parts (21, 22) extending along the open part (2) are arranged in two layers to overlap each other when wearing by using a flat knitting machine. The method of the invention includes the step of performing a course knitting repeatedly in the state in which an adequate number of wales of at least one of the right and left parts of one fabric part having the open part (2), positioned at a lateral end thereof with respect to knitting width, are sent round to the other fabric part retained and knitted on an opposite needle bed, in order that the one fabric part is retained on one needle bed and knitted in the state in which the right and left marginal parts (21, 22) are arranged in line with each other; the step of widening the open part by providing a narrowing knitting to the one fabric part having the open part (2) formed therein; and the step of moving the wales as were sent round to the opposite nnedle bed to an outside of the one fabric part having the open part (2) formed therein.

8 Claims, 16 Drawing Sheets

KNITTED FABRIC HAVING OPEN PART AND KNITTING METHOD THEREFOR

CROSS REFERENCE TO RELATED APPLICATION

This application is a 35 USC § 371 National Phase Entry Application from PCT/JP02/01886, filed Feb. 28, 2002, and designating the U.S.

TECHNICAL FIELD

The present invention relates to a tubular fabric having an open part splitting a part of knitwear vertically, such as a cardigan and a vest having an open part, or a slashed tubular fabric with its marginal parts around the slit overlapped with one part under the other, and to a knitting method thereof.

BACKGROUND ART

The applicant has proposed a basic knitting technique on a seamless knit in Japanese Patent Publication No. Hei 3(1991)-75656. The proposed knitting technique uses a so-called two-bed flat knitting machine comprising front and back needle beds arranged to be opposite to each other, for knitting a knitted fabric into a tubular form with alternate needles of front and back needle beds, for example, using odd needles for a front fabric part and even needles for a back fabric part. When the front fabric part is knitted, the back fabric part is engaged with needles of the back needle bed, while on the other hand, when the back fabric part is knitted, the front fabric part is engaged with needles of the front needle bed, whereby empty needles available to receive and transfer loops of each fabric part are always reserved on the opposite needle bed to knit the front and back fabric parts in the state of being overlapped with one fabric part under the other fabric part. As a result of this, several structure patterns in which front stitches and back stitches are mixed, such as links, purl stitches, and ribs, can be knitted in a tubular form. Also, the use of the empty needles enables the knitted fabric to be moved transversely so as be joined to an adjacent knitted fabric.

A four-bed flat knitting machine further comprising another pair of front and back needle beds can also be used. In this case, front fabric parts of e.g. sleeves and a body, can be knitted with needles of a lower front needle bed and an upper back needle bed, and also back fabric parts thereof can be knitted with needles of a lower back needle bed and an upper front needle bed. Accordingly, when the four-bed flat knitting machine is used, the need to allot the front fabric part to the odd needles and the back fabric part to the even needles, as is required in the two-bed knitting machine, can be eliminated. These knitting techniques can allow producing knitwear in the form of a nearly completed product on the flat knitting machine, and as such can eliminate or simplify the sewing process.

When a vest is knitted seamlessly, front and back bodies of the vest are knitted starting at hems toward a shoulder, while armholes and a neckline opening are formed therebetween. The front and back bodies are joined together at the shoulder and bound off. Similarly, when knitwear with sleeves, including T-sleeve, Set-in sleeve, and Raglan sleeve, is knitted, its body and two sleeves are simultaneously knitted in a tubular form until before armholes and then are joined together from armholes to the shoulder and, then, front and back parts of the body are joined together at the shoulder. These knitwear knitting methods are disclosed by Japanese Laid-open (Unexamined) Patent Publications No. Hei 2(1990)-91254, Hei 2(1990)-229248, Hei 4(1990)-209855, and Hei 4(1992)-153346.

When knitwear, such as a cardigan and a vest with a front open, is knitted, right and left marginal parts extending along the front open, where a placket is usually laid to form button holes and button, must be formed to be overlapped with each other, with one side under the other side, when wearing.

The front body and the back body can be knitted in an overlapped state (double-layer in section) by using alternate needles in the two-bed flat knitting machine for knit, as mentioned above. A multilayer (e.g. a triple-layer and a four-layer) knitted fabric can also be knitted by using every N-number needles such as three needles and every four needles. For example, when a triple-layer knitted fabric in section with its marginal parts overlapped with each other is knitted on the two-bed flat knitting machine, the marginal parts 121, 122 of the front open 102 are knitted, for example, by using every four needles, as shown in FIG. 19. In the drawing, reference numeral 105*r*, 105*l* denote a right front body and a left front body, respectively, and 107 denotes a back body.

However, when the marginal parts 121, 122 are knitted in that manner, distance between one needle and another used to form loops of the marginal parts is increased, resulting in loose loops of the marginal parts and thus inferior texture of the marginal parts. To avoid this problem, the knitted fabric with the open part is commonly knitted in the manner that only the marginal parts are knitted separately from the body parts and then joined to the body parts by sewing in a sewing process. This knitting method is applicable to all types of fabrics with the open part, including the vest or cardigan with the front open, as mentioned above, and a slashed tubular fabric with its marginal parts extending along the slit or open part and overlapped with each other.

It is an object of the present invention that when a knitwear having an open part, such as a slit, formed in a part of fabric knitted in a tubular form and a marginal part(s) extending along the open part, such as a vest or a cardigan, is knitted seamlessly, loops of the marginal part(s) extending along the open part are prevented from being loosened to provide improved texture.

DISCLOSURE OF THE INVENTION

In order to solve the problems mentioned above, the present invention provides a method for knitting a knitted fabric comprising a front fabric part, a back fabric part, an open part, and right and left marginal parts extending along the open part by using a flat knitting machine comprising at least a pair of front and back needle beds, each of which has a large number of needles and at least either of which can be racked laterally to receive and transfer loop between the needle beds, wherein the knitted fabric is knitted in the state in which the front fabric part and the back fabric part are joined to each other at lateral ends of the fabric with respect to knitting width and either of the front fabric part and the back fabric part is split into right and left parts at some midpoint of the knitting width; so that the open part is formed to extend vertically from the splitting place and also the right and left marginal parts comprising an adequate number of wales extending along the open part are arranged in two layers to overlap each other when wearing, the method comprising:

(a) the step of performing a course knitting repeatedly in the state in which the number of wales of at least one of the right and left split parts of one fabric part having the open part formed at a lateral end thereof with respect to knitting width, which is determined in dependence with the number of wales of the marginal part continuous to the fabric part retained and knitted on the opposite needle bed, are previously sent round to the other fabric part retained and knitted on an opposite needle bed, in order that the one fabric part is retained on one needle bed and knitted in the state in which the right and left marginal parts are arranged in line with each other, (b) the step of widening the open part by providing a narrowing knitting to the one fabric part having the open part formed therein, and (c) the step of moving the wales as were previously sent round to the opposite needle bed in the step (a) to an outside of the one fabric part having the open part formed therein.

It is preferable that in the step (b), the opening is widened by moving the right and left marginal parts in a direction in which the right and left marginal parts are moved away from each other, so that the number of empty needles existing between the right and left marginal parts as were arranged in line with each other and knitted in parallel is increased, and the step (c) is taken in continuation to the step (b), such that while the wales as were sent round to the opposite needle bed are racked one stitch by one stitch, the wales are moved to an outside of the one fabric part having the open part formed therein and also re-arrangement of loop for a next course knitting is performed by loop transfer.

It is preferable that the step (b) and the step (c) are repeatedly performed and wherein in the step (b), the open part is widened by keeping the marginal parts stationary and moving the right and left fabric parts adjacent to the fabric part retained on the one needle bed close to each other and then the wales as were sent round to the opposite needle bed are moved to the empty needles formed by widening the open part.

Also, it is preferable that said knitting is provided to both of the right and left fabric parts of the one fabric part having the open part formed therein.

Alternatively, said knitting may be provided to either of the right and left fabric parts of the one fabric part having the open part formed therein.

It is preferable that loops of the wales to be moved in the step (c) are formed by feeding yarn in a direction in which twist in the loops caused by loop transfer is released, in order to prevent occurrence of twisted loops of the wales.

The present invention provides another method for knitting a knitted fabric comprising a front fabric part, a back fabric part, an open part, and right and left marginal parts extending along the open part by using a flat knitting machine comprising at least a pair of front and back needle beds, each of which has a large number of needles and at least either of which can be racked laterally to receive and transfer loop between the needle beds, wherein the knitted fabric is knitted in the state in which the front fabric part and the back fabric part are joined to each other at lateral ends of the fabric with respect to knitting width and either of the front fabric part and the back fabric part is split into right and left parts at some midpoint of the knitting width, so that the open part is formed to extend vertically from the splitting place and also the right and left marginal parts comprising an adequate number of wales extending along the open part are arranged in two layers to overlap each other at knit-up positions thereof, the method comprising:

(a) the step of performing a course knitting in the state in which the number of wales of at least one of the right and left split parts of one fabric part having the open part formed at a lateral end thereof with respect to knitting width, which is determined in dependence on the number of wales of the marginal part continuous to the fabric part retained and knitted on the opposite needle bed, are previously sent round to the other fabric part retained and knitted on an opposite needle bed, in order that the one fabric part is retained on one needle bed and knitted in the state in which the right and left marginal parts are arranged in line with each other, (b) the step of moving the wales to an outside of the one fabric part having the open part formed therein, while the wales as were previously sent round to the opposite needle bed in the step (a) are racked one stitch by one stitch, (c) the step of moving the one fabric part toward the right and left marginal parts to overlap each other by loop transfer and also performing re-arrangement of loop for a next course knitting by the loop transfer, and (d) the step of connecting together the front fabric part and the back fabric part at lateral ends thereof with respect to knitting width after the step (c) and then knitting courses to form an entire knitted fabric into a completely tubular body.

Also, the present invention provides a knitted fabric produced by any one of the methods mentioned above.

According to one aspect of the present invention, when knitwear such as a cardigan and a vest is knitted as a knitted fabric, the knitwear is knitted seamlessly so that the front and back bodies are joined together at lateral ends thereof with respect to knitting width and the vertically extending open part is formed in the front body. According to the present invention, as a substitute for the knitting method wherein the right and left marginal parts are knitted in an overlapping relation on the needle beds so that when wearing, the right and left marginal parts formed along the open part are arranged in two layers to overlap each other, the marginal parts are knitted in the state of being arranged side by side. Although the knitting width of the front body becomes larger than that of the back body on the needle bed by knitting the marginal parts in the state of being arranged in line, since the knitting is performed in the state in which an adequate number of wales of the front body at either or both of right and left side ends thereof are sent round to the back body, the knitting widths of the front and back fabrics knitted on the front and back needle beds can be made generally equal to each other. This can achieve the course knitting of the front and back bodies.

Then, the open part is widened by providing the narrowing knitting to the fabric having the open part formed therein and also the wales as were sent round to the opposite needle bed are moved to outside of the fabric having the open part formed therein. Specifically, the right and left marginal parts are moved toward their respective front body parts to widen the open part. In the cardigan and vest, this knitting forms a neckline opening of the cardigan/vest. As the open part is widened increasingly, the number of empty needles inserted in between the right and left marginal parts increases. Thereafter, the wales at the lateral end of the front body part as were sent round to the opposite needle bed on which the back body is retained are sent to the front body side, while the wales of the front body part are racked one stitch by one stitch, so that those wales can be arranged in line. At the same time as this knitting or after this knitting, the fabric is transferred so that the knitting widths of the front and back bodies on the needle beds can be uniformed for the next course knitting. At this time the loops are rearranged by using the area in which the inserted empty needles are presented, for transference of the knitted fabric.

Alternatively, the front body parts may be moved toward the right and left marginal parts to narrow their knitting widths. This can also substantially widen the open part. By moving the front body parts toward the marginal parts, the empty needles are formed at the outside of the front body parts including the marginal parts retained on the needle bed. The wales at the lateral end of the front body part as were sent to the opposite needle bed are transferred to the empty needles formed each time when the narrowing knitting is repeatedly performed one stitch by one stitch, whereby the knitting width of the front body and that of the back body are uniformed. The knitting widths of the front and back bodies on the needle beds are uniformed in this manner, for the sequent course knitting.

This knitting enables the marginal parts to be integrally knitted with the body and also enables the marginal parts to have solid texture, as compared with the conventional, so that when wearing, they can overlap each other with one side under the other side.

Also, the loops of the wales at the lateral end of the body are formed by feeding yarn in a direction in which twist in the loops caused by loop transfer is released, in order to prevent occurrence of twisted loops of the wales. By virtue of this, the twist can be removed from the wales when the loop transfer is performed sequentially. The knitted fabric knitted in this manner does not spoil its aesthetic form.

According to another aspect of the present invention, as a substitute for the knitting method wherein a fabric, such as an one-piece skirt, is knitted as a knitted fabric in the state in which the front fabric part and the back fabric part are joined together seamlessly at lateral ends of the fabric with respect to knitting width and the front body is split into right and left parts, so that a slit is formed and also the right and left marginal parts are knitted in an overlapping relation on the needle beds so that the right and left marginal parts extending along the slit can be arranged to overlap each other at knit-up positions thereof, the marginal parts are knitted in the state of being arranged side by side. Although the knitting width of the front body becomes larger than that of the back body on the needle bed by knitting the marginal parts in the state of being arranged in line, since the knitting is performed in the state in which an adequate number of wales of the front body at either or both of right and left side ends thereof are sent round to the back body, the knitting widths of the front and back fabrics knitted on the front and back needle beds can be made generally equal to each other. This can achieve the course knitting of the front and back bodies.

Then, after the slit is formed by performing this knitting, the wales at the lateral end of the front body part as were sent round to the opposite needle bed on which the back body is retained are sent to the front body side, while the wales of the front body part are racked one stitch by one stitch, so that those wales can be arranged in line. At the same time as this knitting or after this knitting, the right and left marginal parts are overlapped each other by loop transfer to knit up the slit and narrow the knitting width. Then, fabric is transferred to re-arrange the loops so that a completed tubular body can be knitted by the sequent course knitting. Thereafter, the sequent course knitting proceeds. This knitting enables the marginal parts to be integrally knitted with the body and also enables the marginal parts to have solid texture, as compared with the conventional, so that when wearing, they can overlap each other with one side under the other side.

BRIEF DESCRIPTION OF THE DRAWINGS

FIG. 6 shows the knitting steps 1–4.

FIG. 7 shows the knitting steps 5–8.

FIG. 8 shows the knitting steps 9–12.

FIG. 9 shows the knitting steps 13–16.

FIG. 10 shows the knitting steps 17–21.

FIG. 11 is a view showing an outline flow of the knitting of the second embodiment.

FIGS. 12–15 show the knitting steps according to the third embodiment: FIG. 12 shows the knitting steps 1–4. FIG. 13 shows the knitting steps 5–8. FIG. 14 shows the knitting steps 9–12. FIG. 15 shows the knitting steps 13–14.

FIG. 16 shows a front view of an one–piece dress.

FIG. 17 is a view showing an outline flow of the knitting of a slit tubular part of the one piece of the fourth embodiment.

FIG. 18 shows the knitting steps according to the fourth embodiment.

FIG. 19 is a view showing the conventional knitting method of a three-layer-in-section fabric.

BEST MODE FOR CARRYING OUT THE INVENTION

Figure 1:
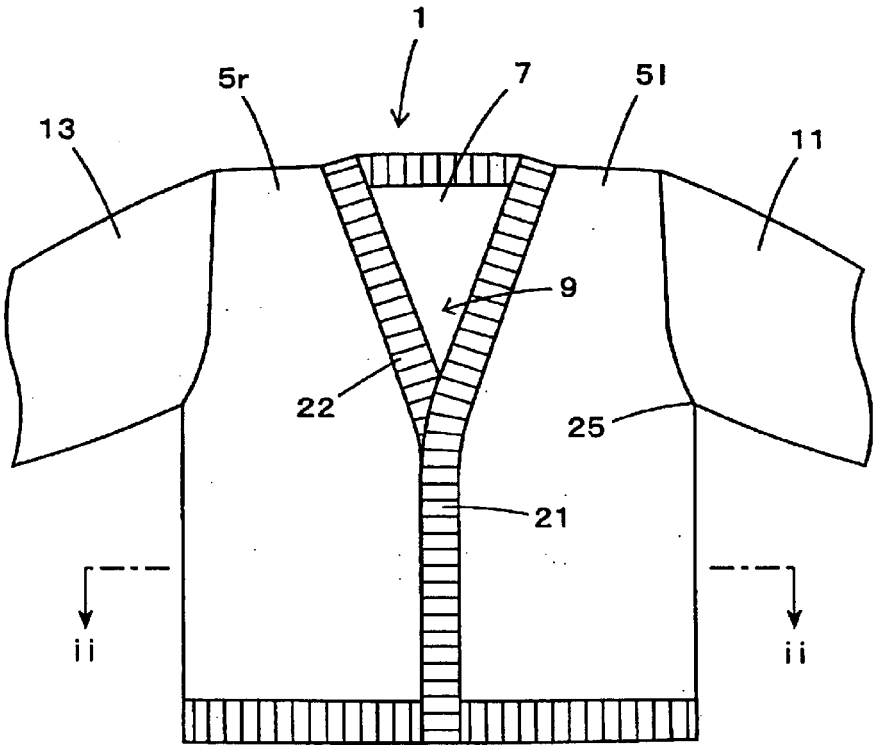
FIG. 1 shows a cardigan knitted in an embodiment of the present invention.
Figure 2:
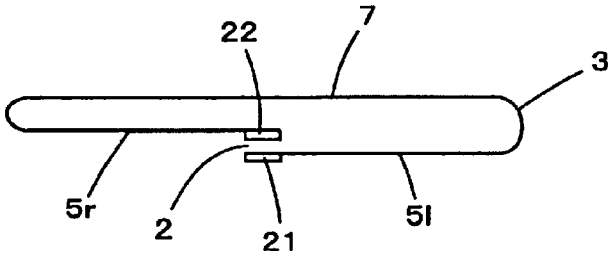
FIG. 2 shows a sectional view of the same taken along line ii—ii of FIG. 1.

In the following, certain preferred embodiments of the present invention will be described with reference to the accompanying drawings. FIG. 1 shows a cardigan 1 as knitwear. FIG. 2 shows a sectional view of the same taken along line ii—ii of FIG. 1. The cardigan 1 is configured so that right and left marginal parts 21, 22 extending along an open part 2 are overlapped with each other with one marginal part under the other marginal part when wearing. Button holes are formed in one of the marginal parts 21, 22, while buttons are attached to the other, though not shown.

In this embodiment, the cardigan 1 is knitted by using a two-bed flat knitting machine. A general type of flat knitting machine is used which has front and back needle beds extending laterally and arranged to be opposite to each other, each of which has a large number of needles and at least either of which can be racked laterally to transfer loops between the needle beds.

Figure 3:
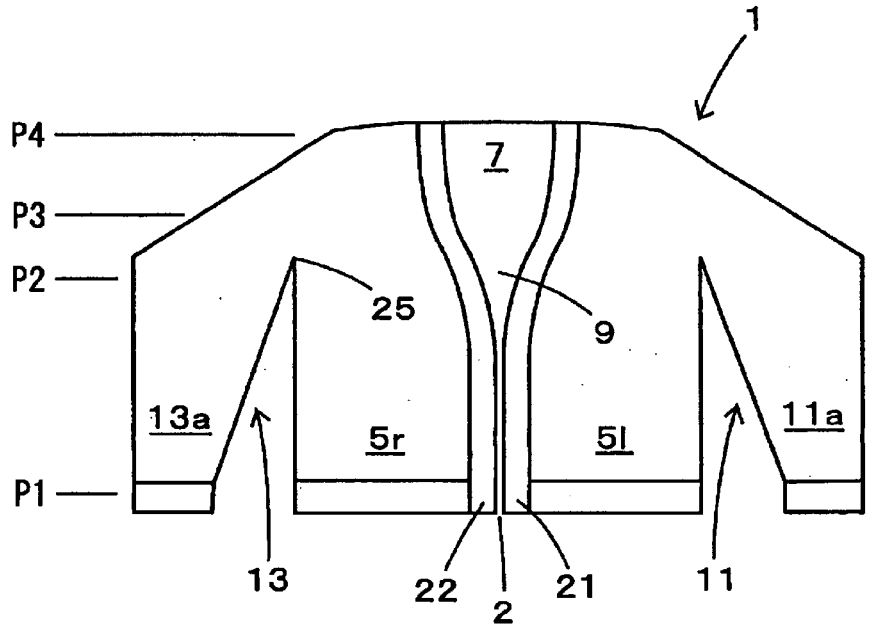
FIG. 3 is a view schematically showing the process step of knitting a cardigan seamlessly by use of a flat knitting machine.
Figure 4:
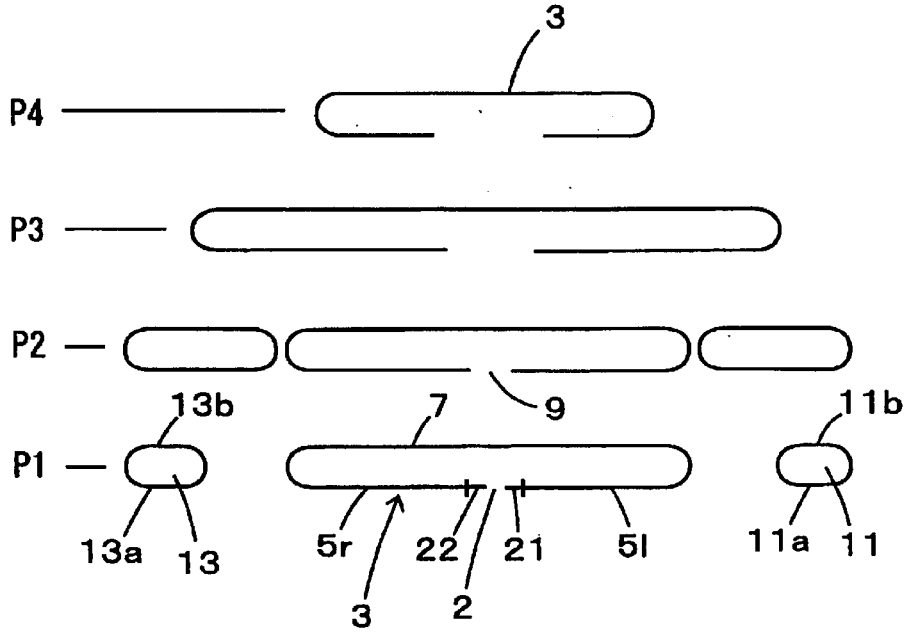
FIG. 4 is a simplified view showing the retained states of the fabric on the needle bed corresponding to the respective stages P1–P4 of FIG. 3.

FIG. 3 schematically shows the process step of knitting the cardigan 1 seamlessly by use of the flat knitting machine. FIG. 4 is a simplified view showing the retained states of the fabric on the needle bed corresponding to the respective stages P1–P4 of FIG. 3. The cardigan 1 is an unpatterned fabric knitted in a plain knitting, except a hem and marginal parts 21, 22.

In the step P1, the cardigan 1 is knitted in the state in which the marginal parts 21, 22 extending along the open part 2 of a front body 5 that come to be overlapped with each other when wearing are arranged in parallel. A body part 3 consisting of the front body 5 and a back body 7 and right and left sleeves 11, 13 are knitted starting from their hems toward a shoulder. The body 3 is knitted in a generally C-shape, for example, via a single yarn feeder (not shown), with the open part 2 as a reversing point of the yarn feeder. The sleeves 11, 13 are knitted from front sleeves 11*a*, 13*a* to back sleeves 11*b*, 13*b* by feeding yarns cyclically from their individual yarn feeders. As a result of this, the body 3 and the sleeves 11, 13 are knitted in a tubular form with their front fabric parts 5, 11*a*, 13*a* and back knitted fabric parts 7, 11*b*, 13*b* joined together at lateral ends thereof by using different regions on the flat knitting machine. The tubular fabric defined herein is intended to include not only a completely enclosed fabric such as a body of a sweater of pullover type but also a partly opened tubular fabric such as a cardigan. In this state, the front fabric part of the body 3 and sleeves 11, 13 is retained on the needles of the front needle bed and the back fabric part of the same is retained on the needles of the back needle bed. This knitting is repeatedly performed to knit a straight part of the marginal parts 21, 22.

In the step P2, the body 3 and the sleeves 11, 13 are simultaneously knitted up to the armhole 25, while the knitting to gradually widen the neckline opening 9 is performed. In the next step P3, the body 3 and the sleeves 11, 13 are joined together at the armhole 25 and formed into a large tubular body. Subsequently, the resultant tubular body is knitted in a C-shape, via a single yarn feeder, with the open part 2 as a reversing point of the yarn feeder, in the same knitting as the knitting to the armhole 25 of the body 3. The step P4 shows the state in which the neckline opening 9 is further widened and the sleeves are nearly all joined to the body. As this knitting step after the joining of the body 3 and the sleeves 11, 13 at the armhole 25 is well known, the detailed description is omitted here.

First Embodiment

In this embodiment, reference is made to the knitting wherein an adequate number of wales 27 ((1)(2)(3)) of one side of the front body 5 (the left front body 5*l* in the illustration) knitted with the needles of the front needle bed and adjacent to the left sleeve 11 are arranged on the back needle bed so that they can be knitted in parallel with the back body 7 knitted with the needles of the back needle bed, in order to make the marginal parts 21, 22 overlap with each other.

Figure 5:
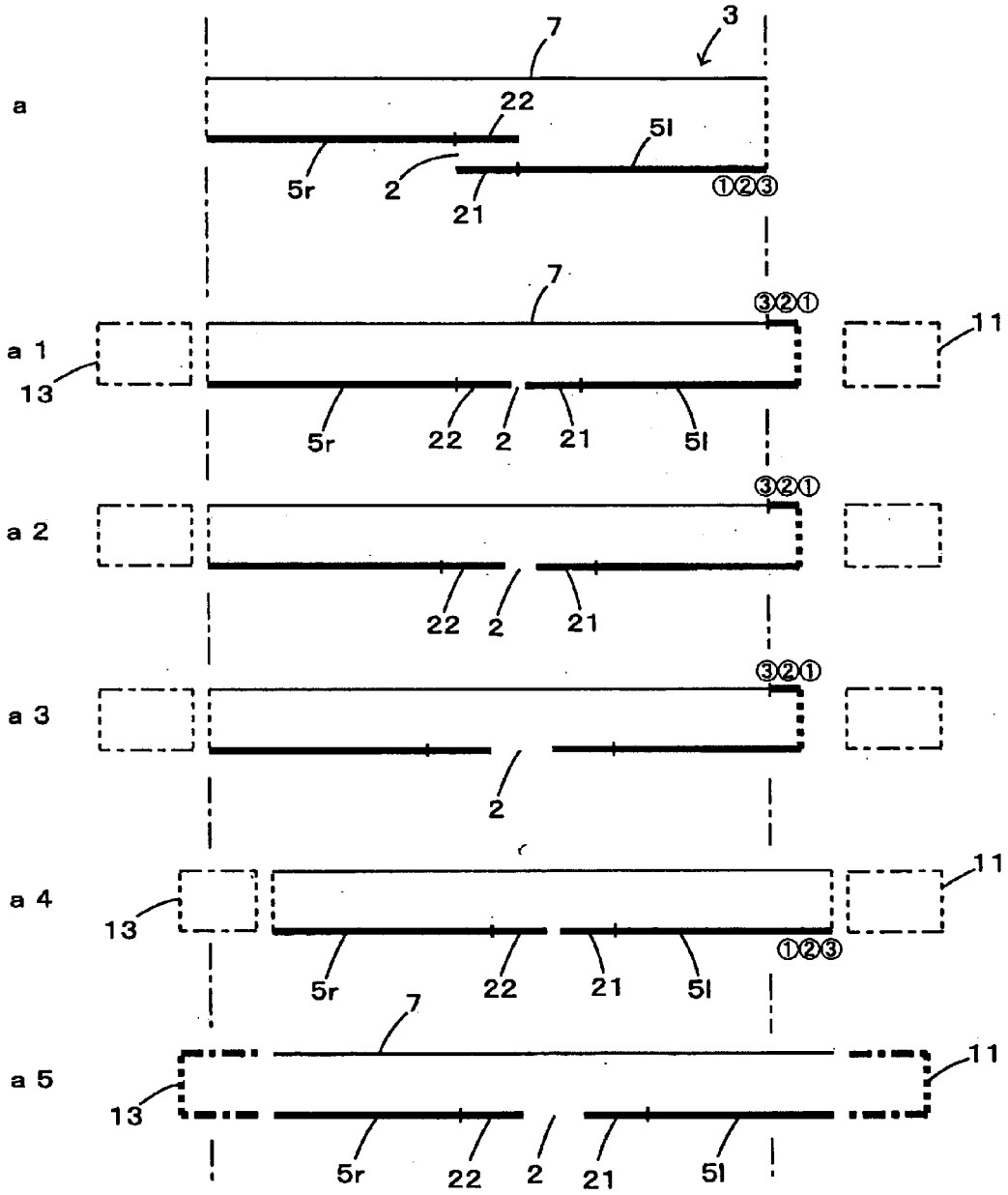
FIG. 5 is a view showing an outline flow of the knitting of the first embodiment.
Figure 6:
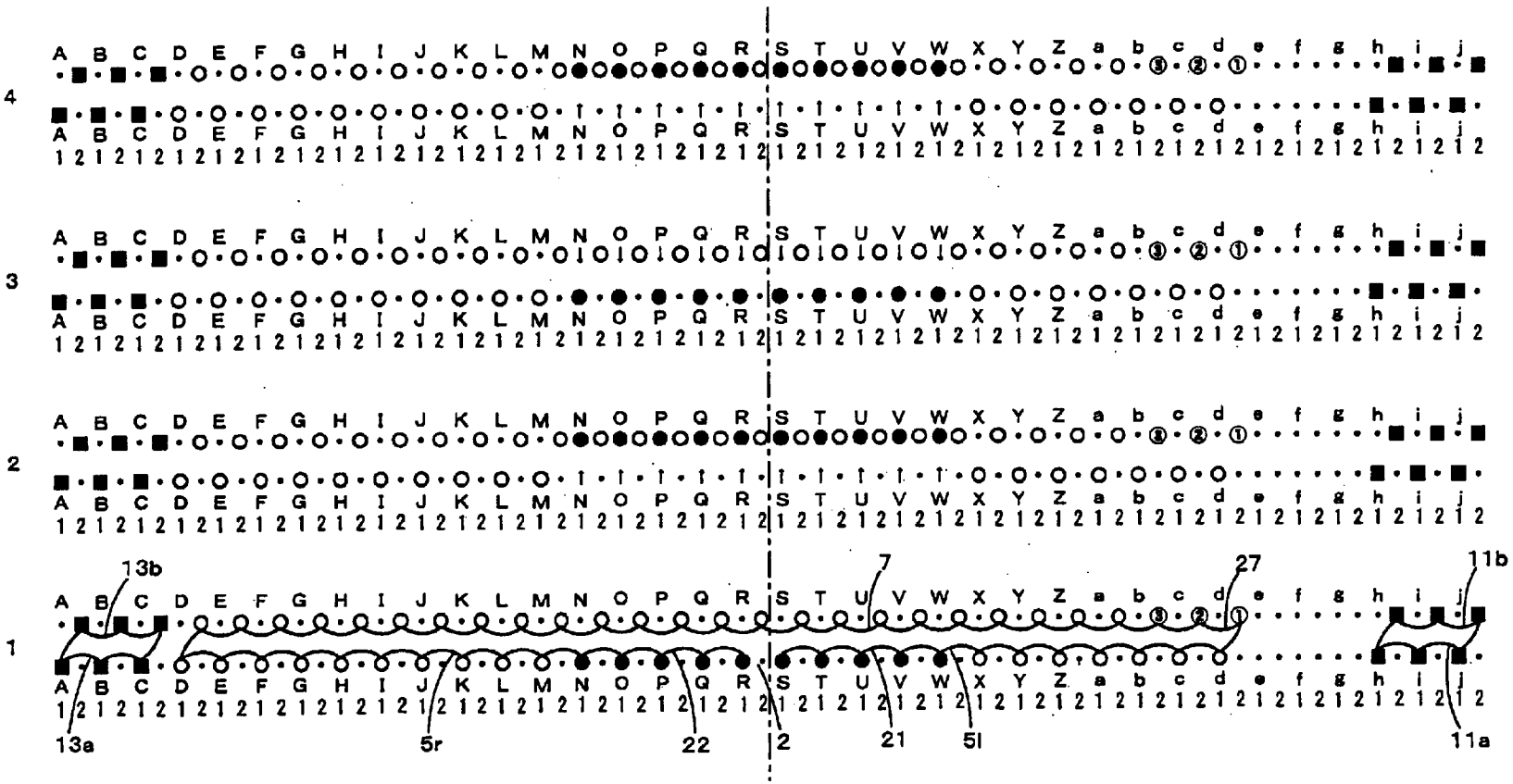
FIGS. 6–19 show the knitting steps according to the first embodiment.
Figure 7:
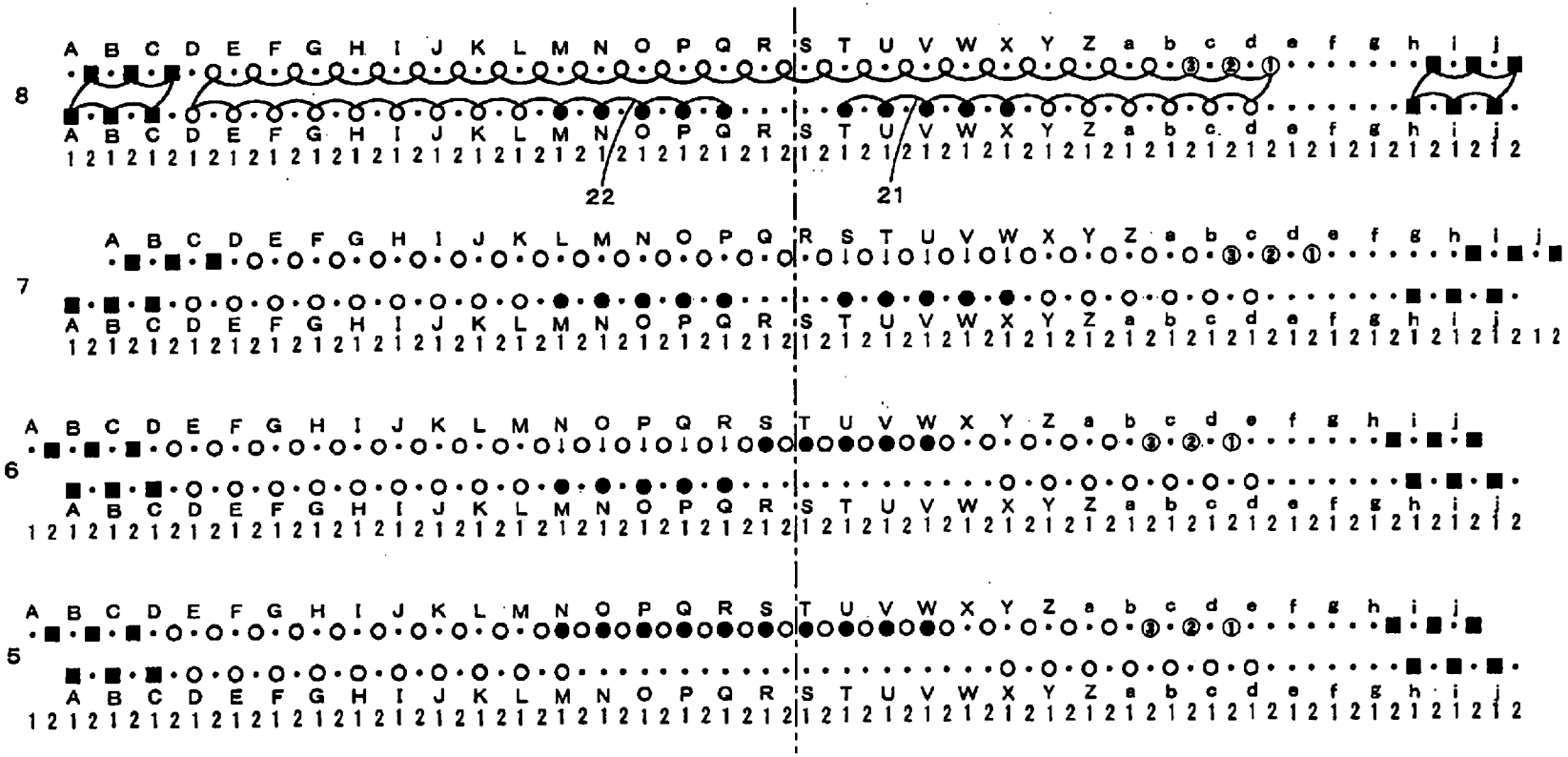
Figure 8:
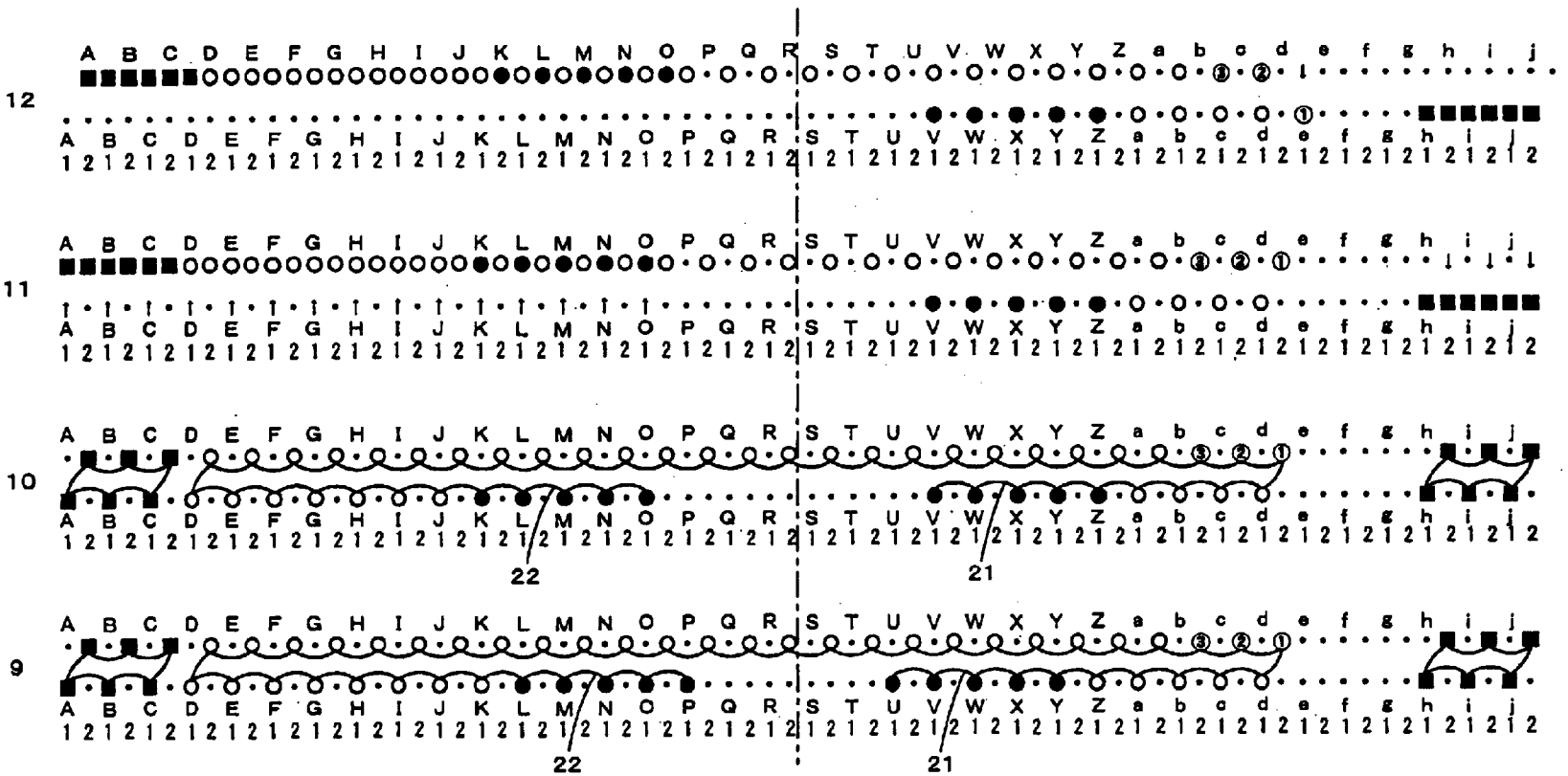
Figure 9:
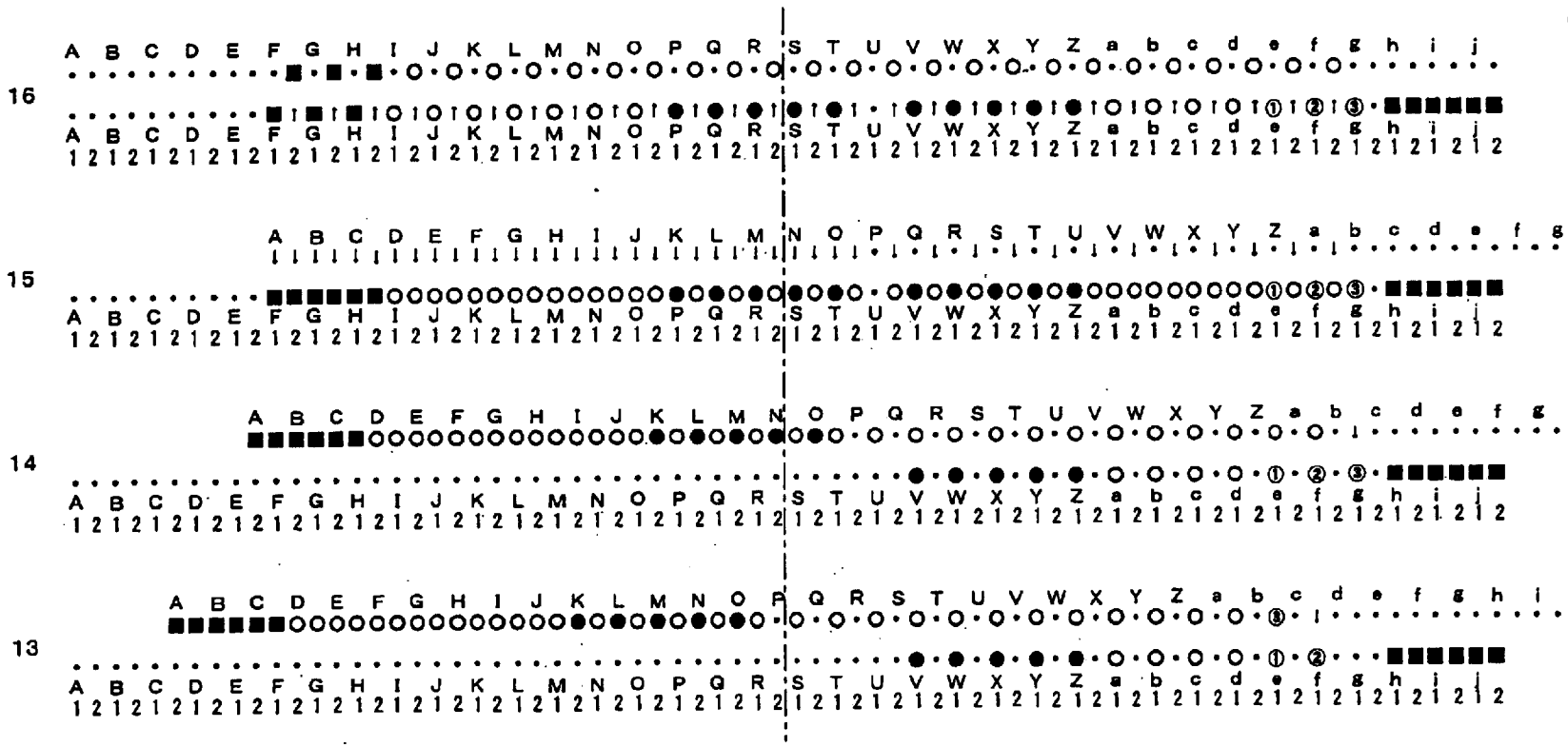
Figure 10:
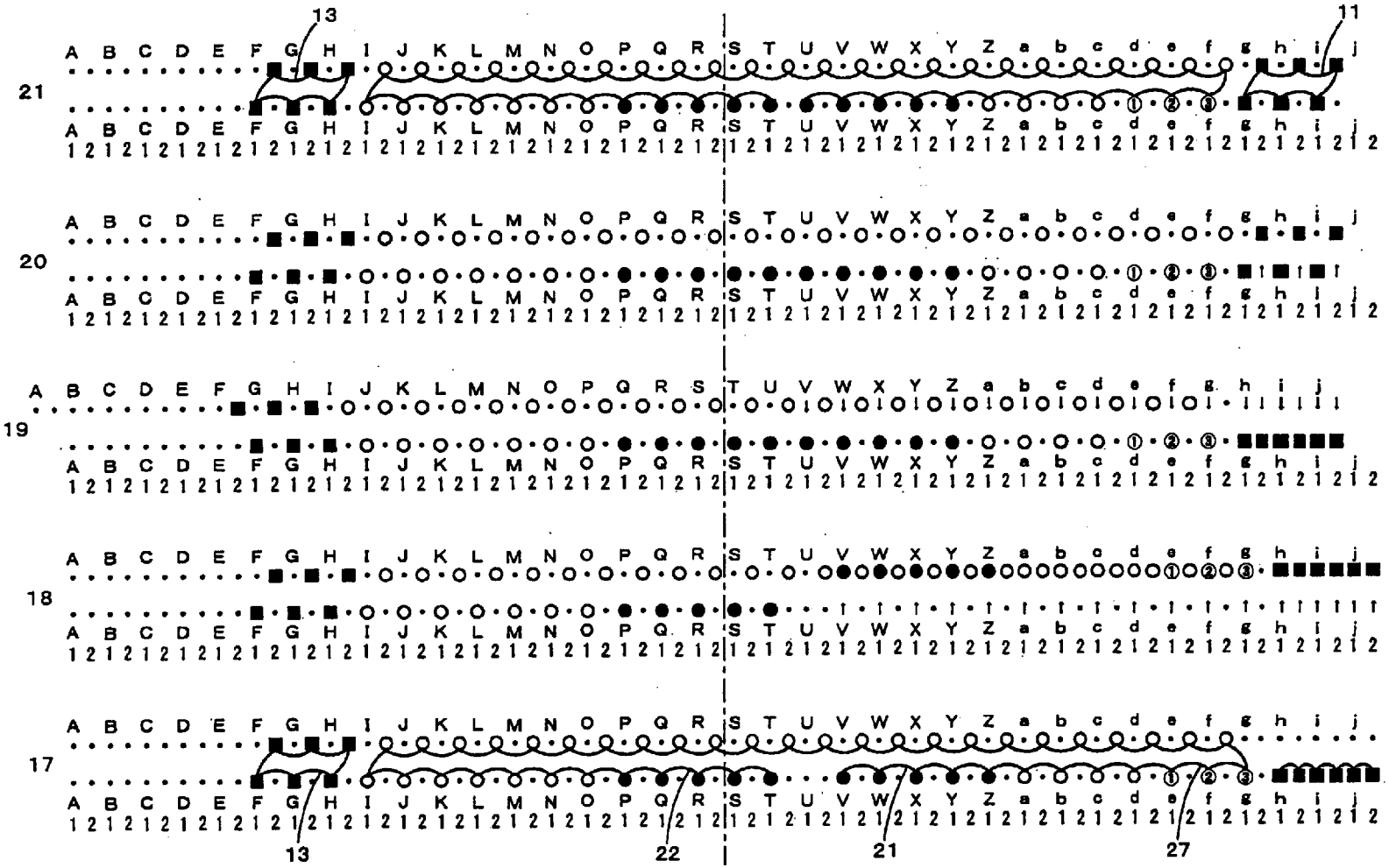

FIG. 5 is a view showing an outline flow of the knitting of the first embodiment. "a" indicates the body 3 after knitted in such a relation that the marginal parts 21, 22 are overlapped with each other with one part under the other part. "a1–a5" show changes of the retained state of the body 3 and the sleeves 11, 13 on the needle bed with the progress of the knitting. In the diagrams, the back body 7 is depicted in a solid line; the front body 5 including the marginal parts 21, 22 is depicted in a bold line; and the sleeves 11, 13 are depicted in a dashed line. A cross-over yarn extending between the front and back needle beds is depicted in a broken line.

"a1" shows the stage at which the knitting is performed in the state in which a part of the left front body 5*l* ((1)(2)(3) in the illustration) is retained on the back needle bed. "a2" and "a3" show the stages at which the space of the open part 2 is widened. "a4" shows the stage at which the part (1)(2)(3) of the left front body 5*l* retained on the back needle bed are sent to the front needle bed and then the right sleeve 13 and a right half of the body 3 are moved rightwards. "a5" shows the stage at which the sleeves 11, 13 and the body 3 are joined together and are knitted further.

FIGS. 6–10 show the detailed knitting steps of each of the steps. In the drawings, for convenience of explanation, an even fewer number of needles used for the knitting than the actual number of needles used for knitting a knitted fabric is illustrated. The numerals at the left side of the drawings indicate the serial number of knitting steps, and the alphabetical characters are marked to alternate needles, with 1 marked to odd number of needles and 2 marked to even number of needles. The front fabric part of the cardigan 1 is knitted with odd needles, except a part of wales 27 ((1)(2)(3)) of the cardigan retained and knitted on the back needle bed, and the back fabric part of the cardigan 1 is knitted with even needles. In the drawings, black circles show loops of the marginal parts 21, 22, and black squares show loops of the sleeves 11, 13.

The step 1 shows the state of straight extending part of the marginal parts 21, 22 being retained on the needle bed (corresponding to the step "a1" of FIG. 5). The right front body 5*r* is retained on the odd needles of the front needle bed indicated by D, E, F, . . . P, Q, P. The left front body 5*l* is retained on the odd needles S, T, U, . . . b, c, d of the front needle bed and on the even needles d, c, b of the back needle bed, so that the loops of wales 27 ((1)(2)(3) in the illustration) at the lateral end of the front fabric part are retained on the even needles d, c, b of the back needle bed. The back body 7 is retained on the even needles D, E, F, . . . Y, Z, a of the back needle bed. The marginal part 22 is retained on the needles N, O, P, Q, R, and the marginal part 21 is retained on the odd needles S, T, U, V, W. The right sleeve 13 is retained on the odd needles A, B, C of the front needle bed. The right front sleeve 13*a* is retained on the even needles A, B, C of the back needle bed, and the right back sleeve 13*b* is retained on the same even needles A, B, C of the back needle bed. The left front sleeve 11*a* is retained on the odd needles h, i, j of the front needle bed, and the left back sleeve 11*b* is retained on the even needles of the back needle bed. The right sleeve 13 is knitted in the vicinity of the body 3, and the left sleeve 11 is knitted, with spaced apart at a certain distance from the body 3, for the following knitting, as will be mentioned later, The marginal parts 21, 22 have a purl stitch structure in which front stitch and back stitch alternate with each other between alternate courses. Letting the state of the step 1 be a racking origin, a racking distance of the needle bed from the racking origin is measured.

First, in the step 1, yarns are fed to the needles retaining the loops of the body 3 and the sleeves 11, 13 retained in the state mentioned above to knit courses of each part. In the step 2, the knitting of the next course is performed, during which the loops of the marginal parts 21, 22 are transferred to the needles of the opposite back needle bed to form back stitches. In the step 3, after the loops of the marginal parts 21, 22 are transferred back to the originally retained needles of the front needle bed, the course knitting is performed. The knitting of the steps 1–3 are repeated in a required number of times, to knit parts of the body 3 along which the marginal parts 21, 22 are extended straight. In the subsequent knitting, the loops of the marginal parts 21, 22 are transferred each time for the course knitting, for knitting the purl stitch, though the explanation thereon is omitted.

The steps 4–10 show the knitting for narrowing wherein the marginal parts 21, 22 are shifted toward their respective front body parts 5*r*, 5*l*, so that adjacent loops therebetween are overlapped with each other. This knitting is performed whenever for example two courses of the body 3 are knitted. The course knitting and the shifting of the marginal parts 21, 22 are repeatedly performed to form the neckline opening 9. This knitting corresponds to the steps a2, a3 of FIG. 5. In the step 4, the marginal parts 21, 22 are transferred to the back needle bed and, thereafter, in the step 5, the back needle bed is racked leftwards two needle pitches. In the next step 6, the marginal part 22 is transferred to odd needles M, N, O, P, Q of the front needle bed to form a double loop on the needle M1. In the step 7, the marginal part 22 is transferred to the odd needles T, U, V, W, X of the front needle bed to form a double loop on the needle X1. The step 8 shows the knitted fabrics retained on the respective needle beds when racked back to the racking origin. It will be understood from this that the needles R1 and S1 of the front needle bed originally retaining the loops thereon turns into empty needles, so that the interval between the marginal parts 21, 22 is widened. The step. 9 shows the state after the shifting of the marginal parts 21, 22 is performed again. The step 10 shows the state after the shifting is performed one more time. As a result of this, the odd needles P, Q, R, S, T, U of the front needle bed retaining the loops of the marginal parts 21, 22 thereon turn into empty needles.

In the sequent steps 11–14, the wales 27 of the left front body 5*l* (those indicated by (1)(2)(3)) knitted on the back needle bed are sequentially sent to the front needle bed, while the back needle bed is racked one stitch by one stitch. In the step 11, the left back sleeve 11*b* is transferred to the front needle bed and also the right front sleeve 13*a* and the right front body 5*r* are transferred to the back needle bed. In the step 12, after the back needle bed is racked rightward at one needle pitch, the (1) of the left front body 5*l* is transferred to the needle e1. In the next step 13, after the back needle bed is racked rightwards at five needle pitches, the (2) is transferred to the needle f1. In the next step 14, after the back needle bed is racked rightwards at nine needle pitches, the (3) is transferred to the needle g1. As a result of this, the wales 27 at the lateral end of the left front body are brought into line outside of the left front body 5*l*.

The wales 27 at the lateral end of the left front body are sent round to the front needle bed in the manner as mentioned above. The following steps 15–20 illustrate the shifting of the knitted fabrics for re-arrangement of loop by using areas where there are provided available empty needles inserted in between the marginal parts 21, 22 for transference of the knitted fabrics so that the front body 5 and the back body 7 can be knitted seamlessly from the armholes 25, including the right and left sleeves 11, 13.

In the step 15, after the back needle bed is racked rightwards at ten needle pitches, the loops of the right sleeve 13, the right front body 5*r* and the back body 7 confronting the right front body 5*r* retained on the needles A–O are all transferred to the needles F–T of the front needle bed and also the remaining loops of the back body 7 are also transferred to the even needles U–f, so that all the needles of the back needle bed are set free. In the step 16, the back needle bed is racked to the racking origin and then the right back sleeve 13*b* and the back body 7 are transferred to the back needle bed. The step 17 illustrates the retained state of the loops after completion of the loop transfer, from which it will be understood that the right half of the cardigan 1 is entirely shifted rightwards so that the loops of the marginal part 21 can be transferred to the empty needles formed by the shifting of the marginal parts 21, 22 in the steps 7–10. In the step 18, the loops of the left front body 5*l* including the marginal part 21 and the loops of the left sleeve 11 are transferred to the back needle bed. In the next step 19, after the back needle bed is racked leftwards at two needle pitches, those loops are transferred back to the opposite needles of the front needle bed. In the step 20, after the back needle bed is returned to the racking origin, the left back sleeve 11*b* is transferred to the opposite needles of the back needle bed. The steps 18–20 are inserted for the purpose of taking the same needle arrangement for knitting the loops of the front and back fabric parts as e.g. the previous step 1 takes so that the fabrics can be knitted in the state that the back fabric part is displaced rightwards from the front fabric part at one needle pitch. Accordingly, these steps are not indispensable. The step 21 illustrates the retained state of the fabrics after completion of the shifting of the fabrics, which step corresponds to a4 of FIG. 5.

This embodiment is just shown by way of example for re-arrange the loops. Although in the illustration, the wales 27 at the lateral side of the fabric are sent round to the front needle bed in the steps 12–14, followed by the re-arrangement of the loops for the next course knitting in the steps 15–20, the knitting of sending the wales 27 at the lateral end of the fabric round to the front needle bed and the knitting of re-arranging the loops may be performed in parallel. Various modifications may also be made to that knitting, including, for example, shifting a left half part of the cardigan 1 leftwards entirely.

From the armhole 25, the course knitting corresponding to a5 of FIG. 5 proceeds. Specifically, the course knitting proceeds toward the shoulder in a continuous C-shape by the yarn feeder being reversed at the open part 2, during which the sleeves 11, 13 are shifted toward the body 3 and overlapped with it, while simultaneously, the knitting for widening the neckline opening 9 further is performed.

In the knitting mentioned above, since the wales 27 of the front body 5 knitted on the back needle bed are sent to the front needle bed so that the next course can be knitted on the front needle bed, the loops of the wales 27 present in the fabric in the form of twisted loop. In order to prevent generation of the twisted loops, the direction for the yarn to be fed to the needles b2, c2, d2 of the back needle bed is preferably reversed to form the loops in the twisted form previously. This can allow the twisted loops to return to normal when the next loop transfer is performed. The same knitting technique can be applied to the following embodiments to avoid the generation of undesirable twisted loops. The detailed explanation is however omitted from the following by reference to the knitting noted above. Like numerals refer to corresponding parts to those of the first embodiment.

Second Embodiment

While in the first embodiment, only the left front body 5*l* of the front body 5 is knitted, with some wales at the lateral end thereof set on the back needle bed, in the second embodiment, both of the right and left front bodies 5*r*, 5*l* are knitted, with some wales at the lateral end of each of the right and left front bodies set on the back needle bed, in other words, the same knitting as that of the first embodiment is performed for both of the right and left front bodies. Thus, since the second embodiment corresponds to a variant of the first embodiment, the knitting of the second embodiment will be easily understood with no reference to the knitting step diagrams like FIGS. 6–10.

Figure 11:
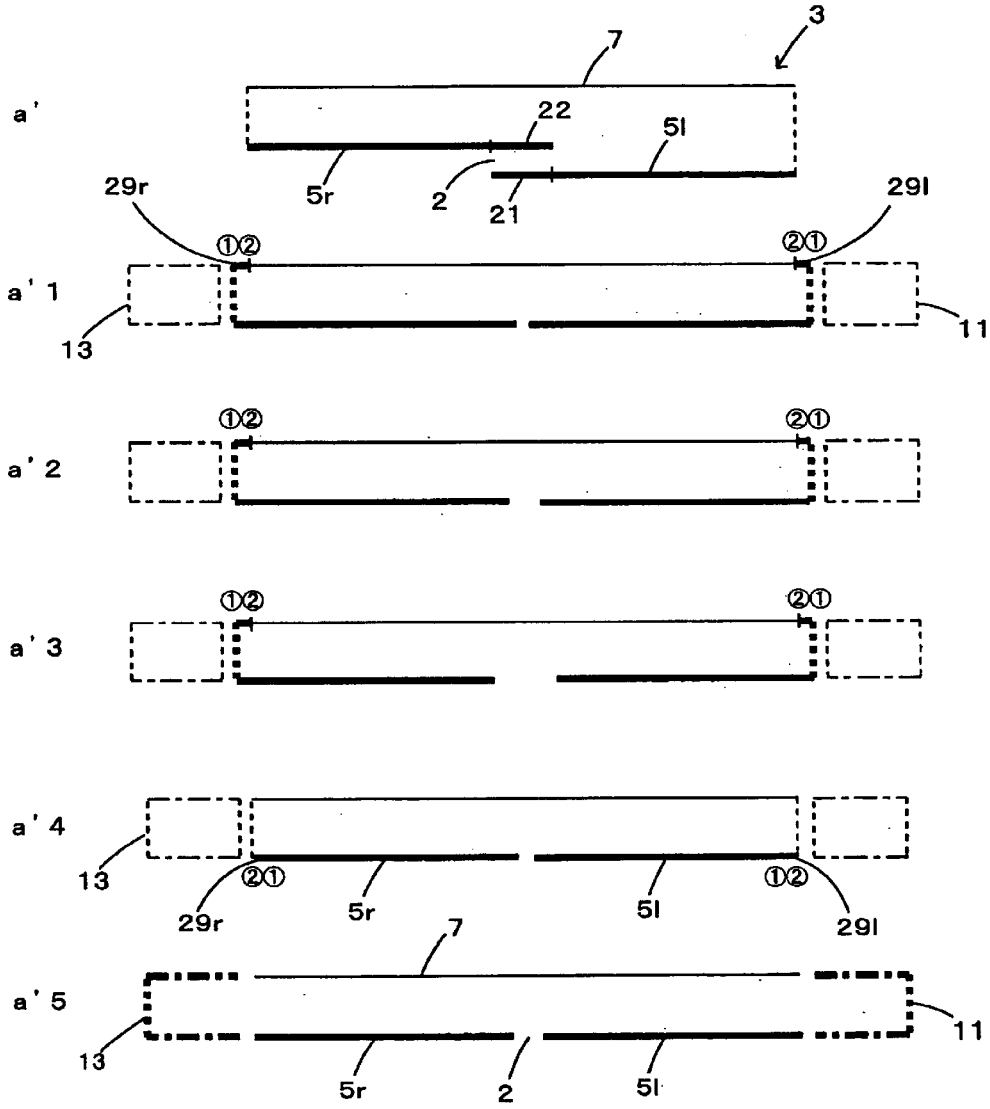
Figure 12:
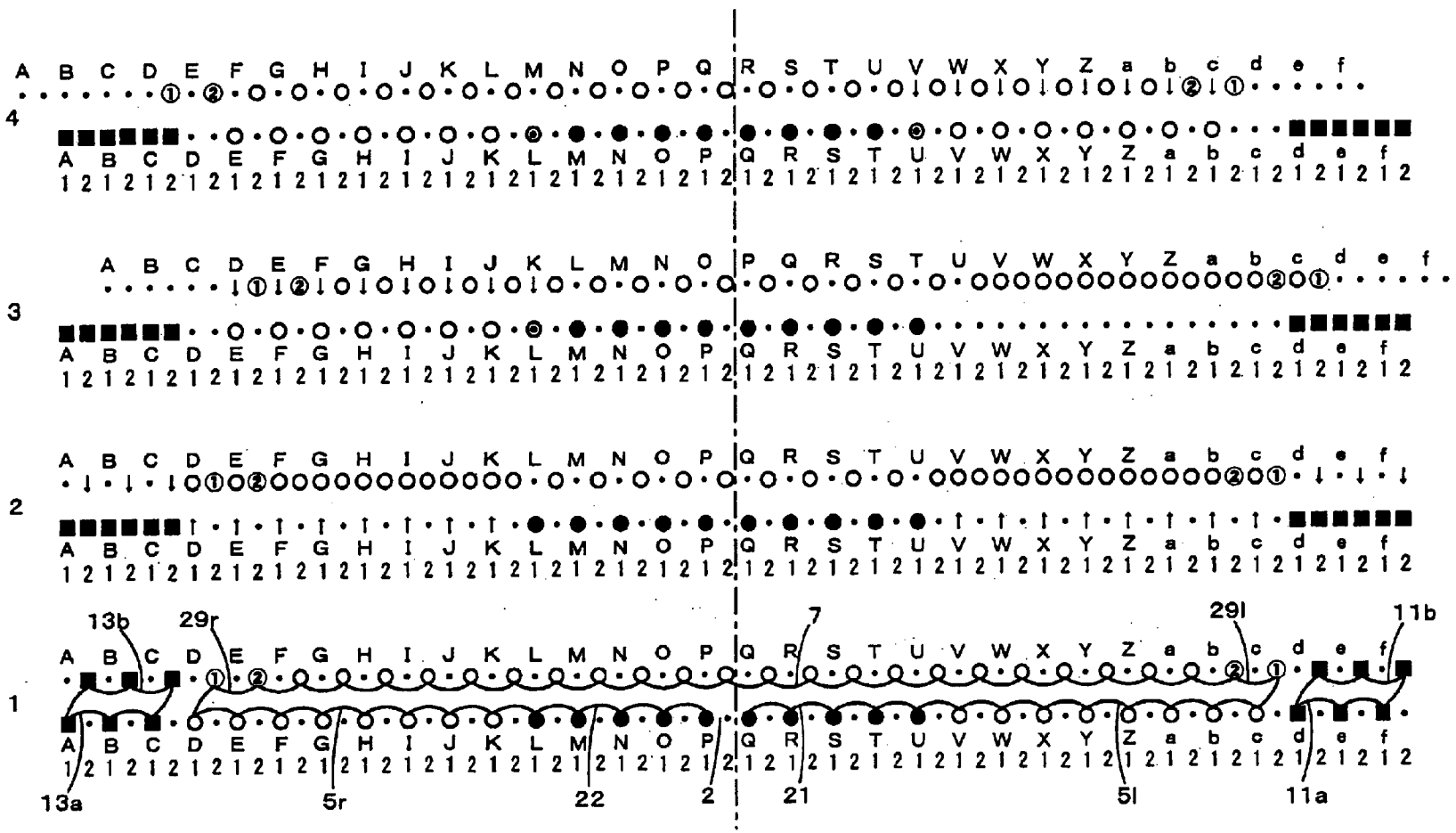
Figure 13:
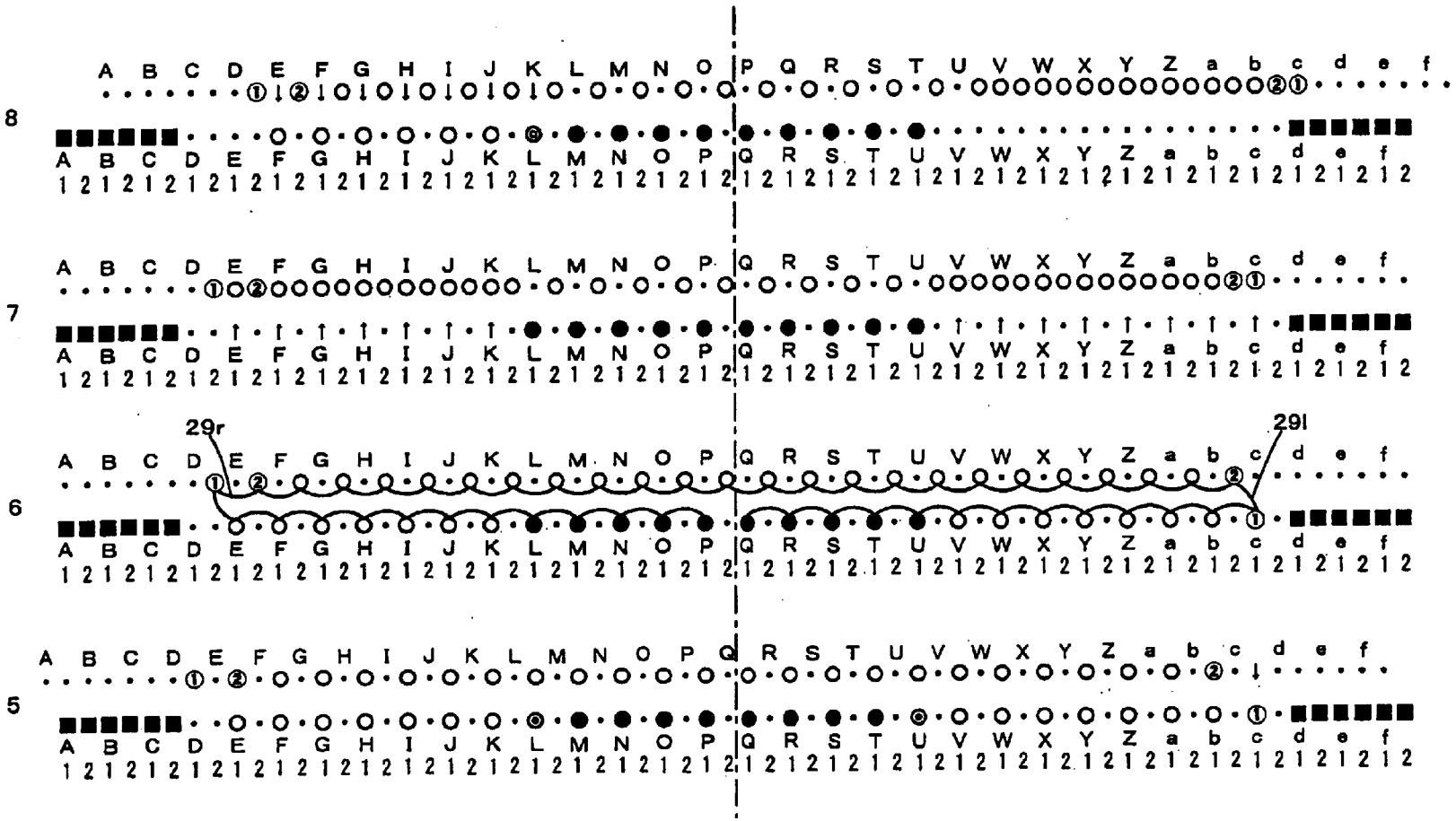
Figure 14:
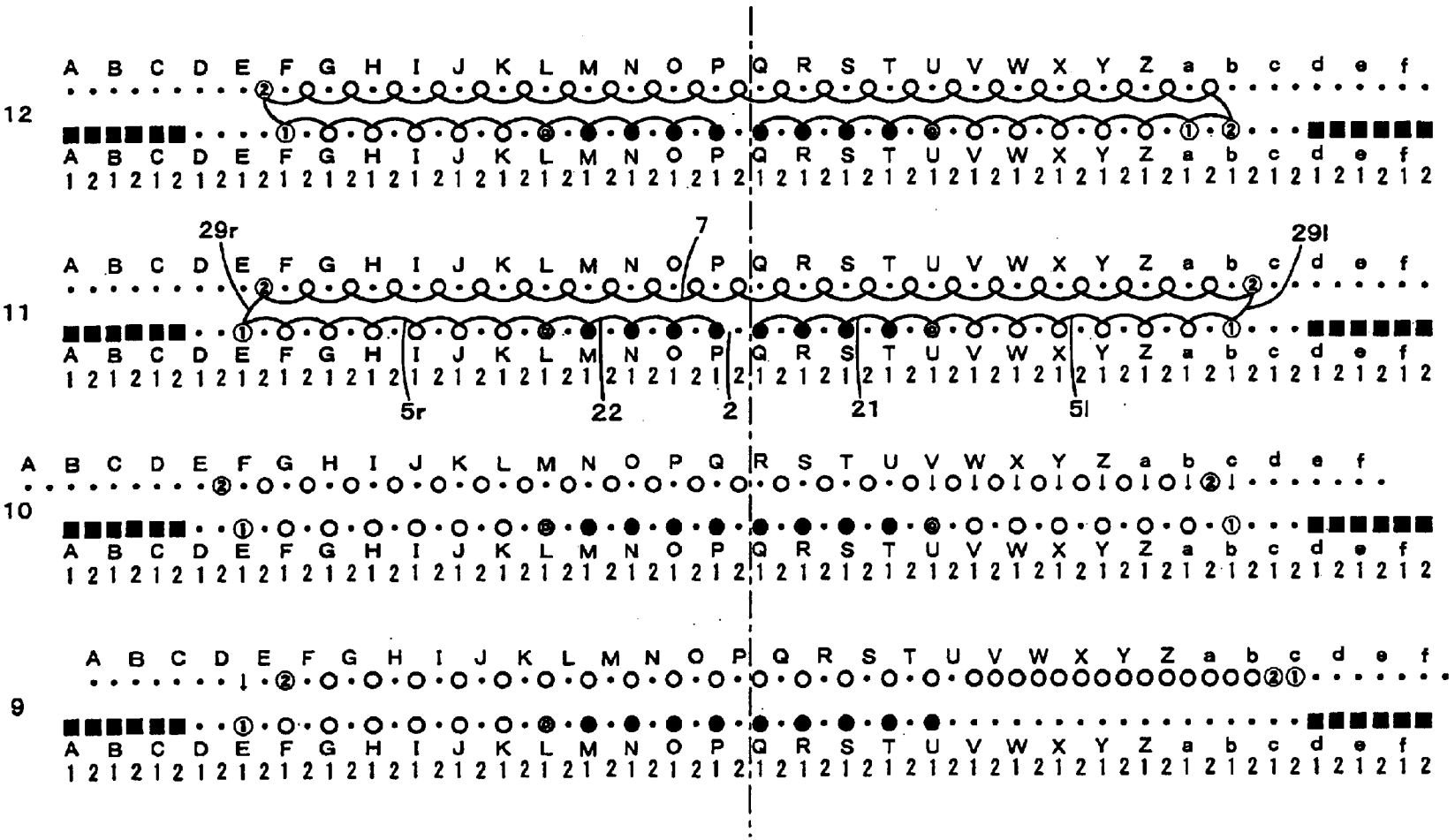
Figure 15:
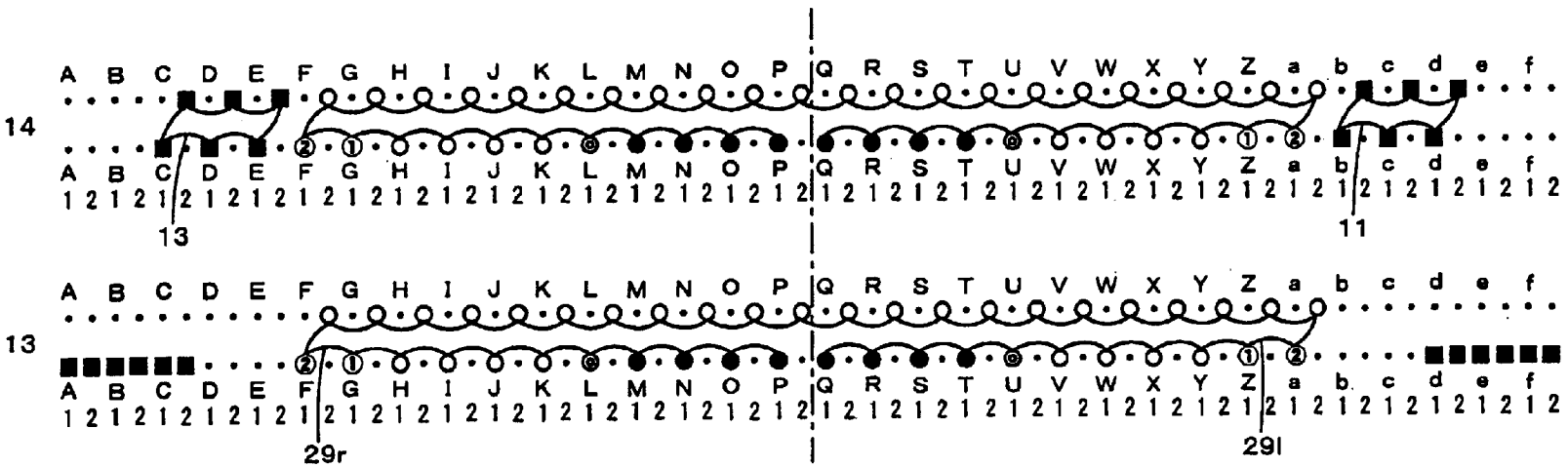

FIG. 11 is a view showing an outline flow of the knitting of the second embodiment, which corresponds to FIG. 5 of the first embodiment. "a'" shows the body 3 after knitted in such a relation that the marginal parts 21, 22 are overlapped with each other with one part under the other part. "a'1–a'5" show changes of the retained state of the body 3 and the sleeves 11, 13 on the needle bed with the progress of the knitting. "a'1" shows the stage at which the knitting is performed in the state in which wales 29*r*, 29*l* at the lateral ends of the right and left front bodies 5*r*, 5*l* ((1)(2) in the illustration) are retained on the back needle bed. "a'2" and "a'3" show the stage at which the marginal parts 21, 22 are moved outwards to widen the space of the open part 2 so as to form the neckline opening 9. "a'4 " shows the stage at which the loops of the wales at the lateral ends of the front body 5*r*, 5*l* retained on the back needle bed are sent to the front needle bed and also the front bodies 5*r*, 5*l* and the sleeves 11, 13 are transferred to the empty needles formed by moving the marginal parts 21, 22 and re-arrangement of the loops is performed for transfer of the sleeves 11, 13. "a'6" shows the stage at which the sleeves 11, 13 and the body 3 are joined together and are knitted further. In this second embodiment, the right and left front bodies 5*r*, 5*l* are symmetrically knitted on the needle bed, differently from the first embodiment.

Third Embodiment

While in the embodiments mentioned above, the neckline opening is widened and also the knitting width of the front body is narrowed by shifting the right and left marginal parts toward their respective bodies in the process of the knitting of the body, the third embodiment illustrated provides the same effect by shifting the front body, rather than by shifting the marginal parts.

FIGS. 12–15 show the knitting steps according to the third embodiment. The step 1 shows the state of straight extending parts of the marginal parts 21, 22 being retained on the needle bed (corresponding to the step "a'1" of FIG. 11). The right front body 5*r* is retained on the odd needles of the front needle bed indicated by D, E, F, . . . N, O, P and the wales 29*r* ((1)(2) in the illustration) at a lateral end of the right front body 5*r* are retained on even needles D, E of the back needle bed. The left front body 5*l* is retained on the odd needles Q, R, S, . . . a, b, c of the front needle bed and the wales 29*l* ((1)(2) in the illustration) at a lateral end of the left front body 5*l* are retained on even needles c, b of the back needle bed. The back body 7 is retained on the even needles F, G, H, . . . Y, Z, a of the back needle bed. The marginal parts 21, 22 extending along the open part 2 each comprise five wales. The marginal part 22 is retained on the needles L, M, N, O, P, and the marginal part 21 is retained on the odd needles Q, R, S, T, U. The right sleeve 13 is retained on the odd needles A, B, C of the front needle bed. The right front sleeve 13*a* is retained on the even needles A, B, C of the back needle bed, and the right back sleeve 13*b* is retained on the same even needles A, B, C of the back needle bed. The left front sleeve 11*a* is retained on the odd needles d, e, f of the front needle bed, and the left back sleeve 11*b* is retained on the even needles of the back needle bed. While the marginal parts 21, 22 may have a purl stitch structure as mentioned in the embodiments previously mentioned, the description thereon is omitted here. In the step 1, yarns are fed to the needles retaining the loops of the body retained in the state mentioned above, to knit courses of each part. In the next step 2, the loops of the right front body 5*r* retained on the odd needles D, E, F, . . . I, J, K of the front needle bed and the loops of the left front body 5*l* retained on the odd needles V, W, X, . . . a, b, c are transferred to the back needle bed. At that time, the right back sleeve 13*b* and the left back sleeve 11*b* are transferred to the front needle bed so that when racking is performed in the following knitting, no load is applied to the loops of the sleeves. In the step 3, after the back needle bed is racked rightwards at two needle pitches, the loops of the right front body 5*r* are transferred to the needles of the opposite front needle bed, in order to shift the loops of the right front body 5*r* toward the marginal part 22. As a result of this, the loop of the right front body 5*r* originally retained on the odd needle K of the front needle bed and the loop at the lateral end of the marginal part 22 are overlapped with each other and, as a result, the number of wales is reduced by one wale. Likewise, in the step 4, after the back needle bed is racked leftwards at two needle pitches, the loops of the left front body 5*l* are shifted toward the marginal part 21. In the next step 5, after the back needle bed is racked leftwards at one needle pitch, the loop (1) of the wale 29*l* at the lateral end of the left front body 5*l* retained on the even needle c of the back needle bed is transferred to the needle of the front needle bed. Letting the state of the step 6 be a racking origin, the following course knittings are performed.

The steps 7–9 show the knitting for narrowing the body. In the step 7, the loops of the right front body 5*r* retained on the odd needles E, F, . . . I, J, K of the front needle bed and the loops of the left front body 5*l* retained on the odd needles V, W, X, . . . a, b, c are transferred to the back needle bed. In the step 8, after the back needle bed is racked rightward at two needle pitches, the loops of the right front body 5*r* are transferred to the needles of the front needle bed, whereby the loop at the end of the right front body 5*r* is overlapped with the loop at the lateral end of the marginal part 22. In the next step 9, after the back needle bed is racked rightwards at one needle pitch, the loop (1) of the wale 29*r* at the lateral end of the right front body 5*r* retained on the even needle D of the back needle bed is transferred to the needle of the front needle bed. In the step 10, after the back needle bed is racked leftwards at two needle pitches, the loops of the left front body 5*l* are transferred to the needles of the front needle bed, whereby the loop of the left front body 5*l* is overlapped with the loop of the marginal part 21. As a result of the knitting steps so far, two wales are reduced from each of the right front body 5*r* and the left front body 5*l*.

The step 11 shows the retained state of the loops of the fabric when the back needle bed is in the racking origin after the step 10 is ended. In the following knitting of the body, the same knitting as those of the steps 2–10 are repeatedly performed, whereby the front bodies 5*r*, 5*l* are moved toward the marginal parts 21, 22. The step 12 shows the retained state of the loops of the fabric when the stitch move is performed one more time. The step 13 shows the retained state of the loops of the fabric when the stitch move is performed yet another time. The step 14 shows the state in which the right and left sleeves 11, 13 are moved to the lateral sides of the body. As mentioned above, in this embodiment, the loops of the marginal parts 21, 22 are put in the fixed state and whenever a certain number of courses are knitted, the right and left front bodies 5*r*, 5*l* are gradually moved toward their respective marginal parts 21, 22, to thereby form the neckline opening. In addition, the loops of the wales 29*r*, 29*l* at the lateral ends of the front bodies sent to the back needle bed are transferred to the empty needles of the front needle bed formed by the knitting for the narrowing mentioned above.

Fourth Embodiment

Figure 16:
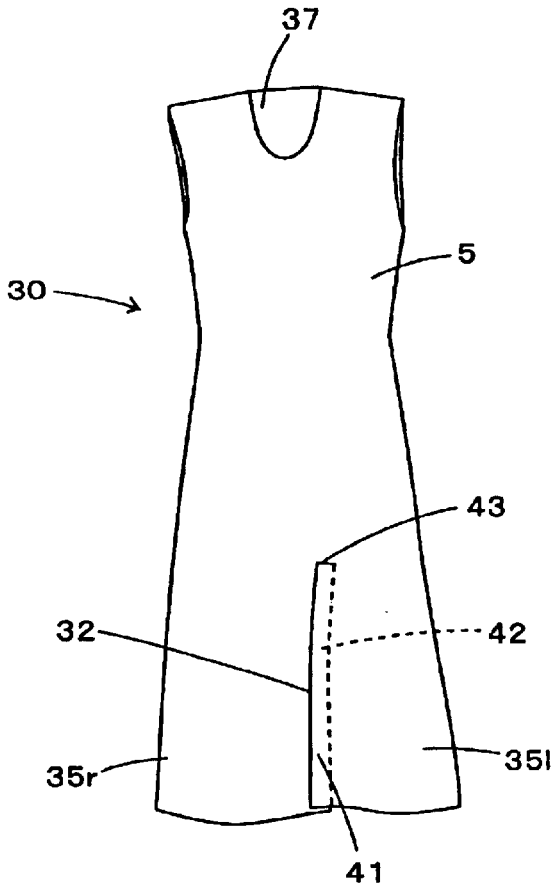
Figure 17:
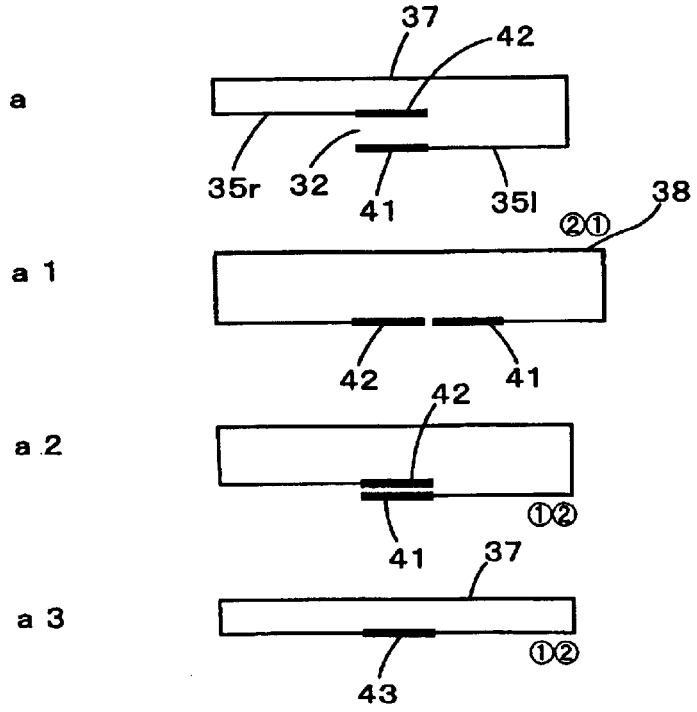
Figure 18:
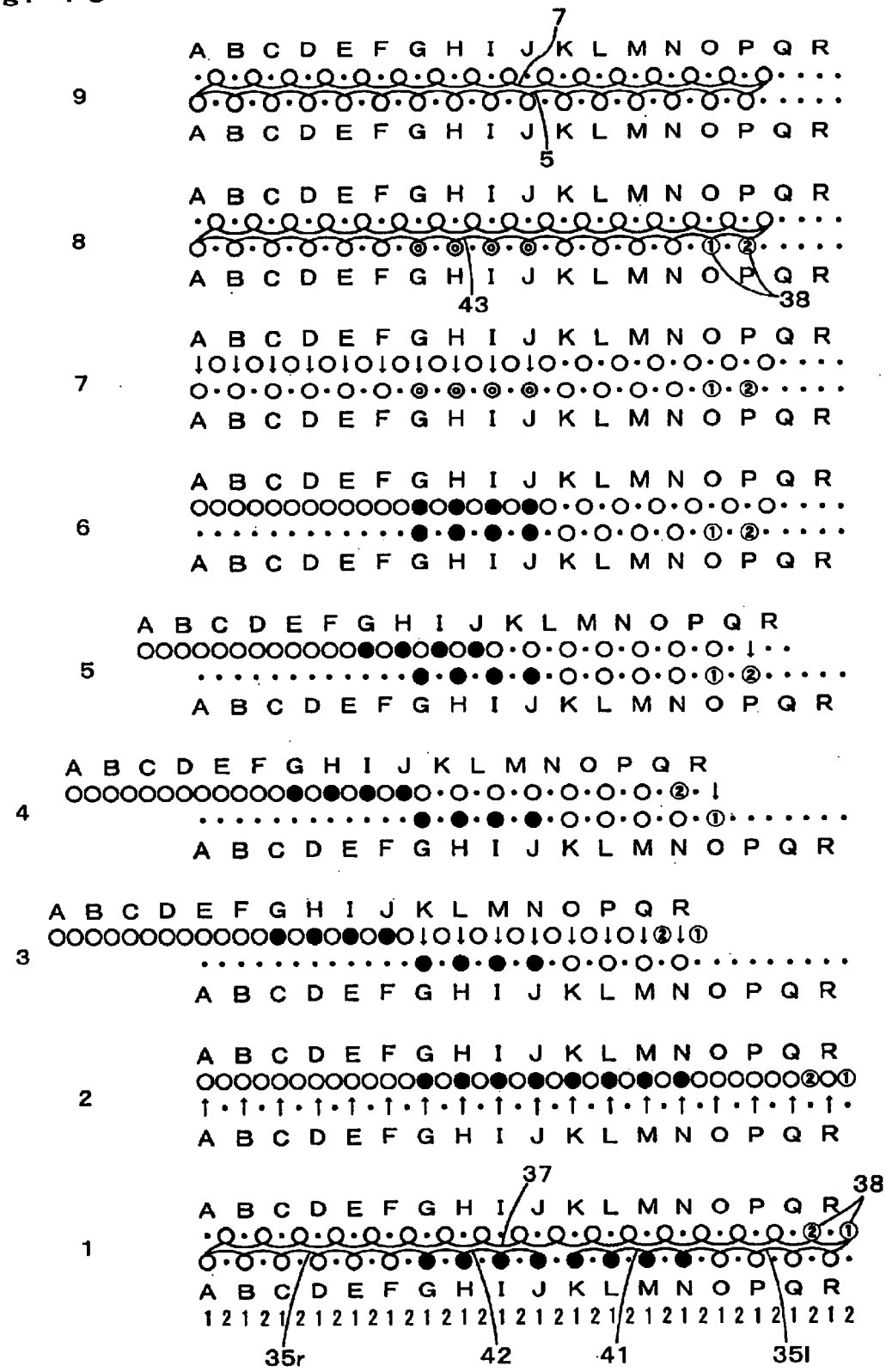
Figure 19:
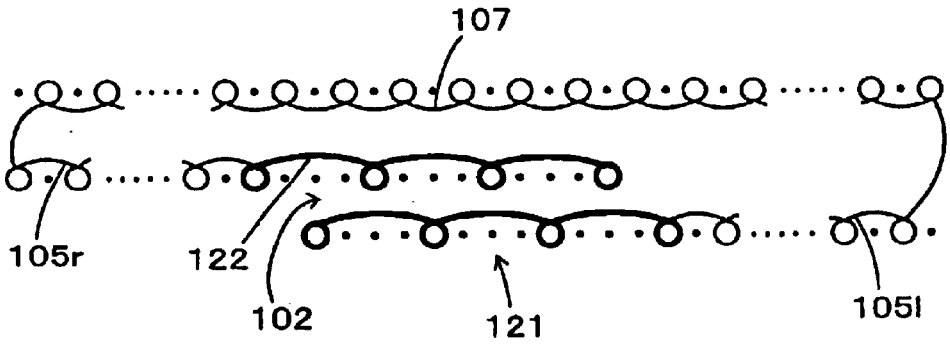

Next, reference is made to an embodiment according to which the method of the present invention is applied to the knitting for forming a slit (open part) 32 in a front part of a skirt 30 of a tubularly-knitted one-piece at a center thereof. FIG. 16 shows a front view of the one-piece skirt 30. 41, 42 denote the marginal parts. 35*r*, 35*l* denote the right and left front bodies and 37 denotes the back body. FIG. 17 is a view showing an outline flow of the knitting of a slit 32 tubular part. FIG. 18 shows the knitting steps thereof. The skirt is an unpatterned plain knit structure including the marginal parts 41, 42.

FIG. 17*a* shows the state of part of the fabric after knitting where the slit 32 is formed between the marginal parts 41, 42 overlapped with each other, a1 shows the stage at which the fabric is knitted in the state in which the marginal parts 41, 42 extending along the slit 32 are arranged in parallel by putting the wales 38 ((1)(2) in FIG. 18) at a lateral end of the left front body 35*l* in the state of being retained on the back needle bed. a2 shows the stage at which the marginal parts 41, 42 are butted after forming the slit 32. a3 shows the stage at which the marginal parts 41, 42 are put in the overlapped state.

In FIG. 18, the step 1 shows the retained state of the loops on the needle beds in the stage a2. In the step 1, the wales 38 ((1)(2)) at the lateral end of the left front body 35*l* continuous to the back body are arranged so that they can be knitted with needles of the back needle bed. In this state, the course knitting is performed in a continuous C-shape by the yarn feeder being reversed at the slit 32, to obtain the slit 32 having a required length. In the step 2, the loops of the front bodies 35*r*, 35*l* are transferred to the back needle bed. In the next step 3, after the back needle bed is racked leftwards at eight needle pitches, the marginal part 41 is transferred to the needles G1, H1, I1, J1 of the front needle bed on which the marginal part 42 was retained. In the steps 4 and 5, after the back needle bed is racked leftwards at seven needle pitches and then at three needle pitches, the loops of the wales 38 of the left front body 35*l* are transferred to the needles O and P.

In the step 6, the back needle bed is returned to the racking origin, so that the marginal part 42 is made to confront the marginal part 41. In the next step 7, the loops of the right front body 35*r* as was retained on the back needle bed are transferred to the front needle bed. The step 8 shows the retained state of the loops after completion of loop transfer. The loops of the marginal parts 41, 42 are retained on the needles G1, H1, I1, J1 in the form of double loop. In the step 9, the yarn is fed to the odd needles A, B, . . . O, P of the front needle bed to perform the next course knitting continuous to the form of the double loops of the marginal parts 41, 42, so as to join together the marginal parts 41, 42. Sequentially, the yarn is fed to the even needles P, O, . . . B, A of the back needle bed to perform the course knitting of the back body. Subsequently, the knitting of the step 9 is repeatedly performed to form a completely encircled tubular body. The sequence of the loop transfer required for the retained loop to be transferred, from the state of the step 1 to the state of the step 8 is not limited to that of the method mentioned above. Various modifications may be made of the method, as long as such modifications can produce the result of the step 8.

While in the first embodiment, the marginal parts of the purl stitch pattern is taken by way of example, the knitting pattern of the marginal parts is not limited to the purl stitch pattern. It is needless to say that the marginal parts may be formed to have the same knitting pattern as that of other parts of the fabric than the marginal parts. In this modification also, the distance between adjacent needles available for forming the loops of the marginal parts is not broadened, differently from the conventional art, thus preventing deterioration of the texture. It is preferable that the marginal parts have good resistance to curl and high form stability to keep their forms stably. Also, it is needless to say that only the marginal parts may be knitted by using additional yarn or thicker yarn. The number of wales of the marginal parts to be overlapped with each other may be increased, although as the number of wales at the lateral end of the fabric increases, the number of wales to be sent round to the opposite needle bed and knitted increases. By knitting the marginal parts in that manner, a design like a double breast can also be made. The method of the present invention can be practically applied to a flat knitting machine, such as the four-bed flat knitting machine, having higher performance than a general type of knitting machine, as well as to the two-bed flat knitting machine. Also, although the knitting method applied to the knitting of the cardigan or the one-piece skirt is illustrated by way of example, this is not limitative. For example, when button and button holes are attached to and formed in cuffs having open part as well as the vest having open part, knitwear of a suit-like form, such as knitted suit, can be knitted seamlessly. It is needless to say that changes and modifications may be made in the present invention without departing from the spirit of the invention or from the scope of the appended claims. For example, the knitting may proceed in the state in which the open part is formed in the back body, rather than in the front body, and the wales at the lateral end of the back body are, disposed on the front body side.

What is claimed is:

1. A method for knitting a knitted fabric comprising a front fabric part, a back fabric part, an open part, and right and left marginal parts extending along the open part by using a flat knitting machine comprising at least a pair of front and back needle beds, each of which has a large number of needles and at least either of which can be racked laterally to receive and transfer loop between the needle beds, wherein the knitted fabric is knitted in the state in which the front fabric part and the back fabric part are joined to each other at lateral ends of the fabric with respect to knitting width and either of the front fabric part and the back fabric part is split into right and left parts at some midpoint of the knitting width, so that the open part is formed to extend vertically from the splitting place and also the right and left marginal parts comprising an adequate number of wales extending along the open part are arranged in two layers to overlap each other when wearing, the method comprising:

(a) the step of performing a course knitting repeatedly in the state in which the number of wales of at least one of the right and left split parts of one fabric part having the open part formed at a lateral end thereof with respect to knitting width, which is determined in dependence on the number of wales of the marginal part continuous to the fabric part retained and knitted on the opposite needle bed, are previously sent round to the other fabric part retained and knitted on an opposite needle bed, in order that the one fabric part is retained on one needle bed and knitted in the state in which the right and left marginal parts are arranged in line with each other, (b) the step of widening the open part by providing a narrowing knitting to the one fabric part having the open part formed therein, and (c) the step of moving the wales as were previously sent round to the opposite needle bed in the step (a) to an outside of the one fabric part having the open part formed therein.

2. The method for knitting a knitted fabric according to claim 1, wherein in the step (b), the opening is widened by moving the right and left marginal parts in a direction in which the right and left marginal parts are moved away from each other, so that the number of empty needles existing between the right and left marginal parts as were arranged in line with each other and knitted in parallel is increased, and wherein the step (c) is taken in continuation to the step (b), such that while the wales as were sent round to the opposite needle bed are racked one stitch by one stitch, the wales are moved to an outside of the one fabric part having the open part formed therein and also re-arrangement of loop for a next course knitting is performed by loop transfer.

3. The method for knitting a knitted fabric according to claim 1, wherein the step (b) and the step (c) are repeatedly performed and wherein in the step (b), the open part is widened by keeping the marginal parts stationary and moving the right and left fabric parts adjacent to the fabric part retained on the one needle bed close to each other and then the wales as were sent round to the opposite needle bed are moved to the empty needles formed by widening the open part.

4. The method for knitting a knitted fabric according to claim 1, wherein said knitting is provided to both of the right and left fabric parts of the one fabric part having the open part formed therein.

5. The method for knitting a knitted fabric according to claim 1, wherein said knitting is provided to either of the right and left fabric parts of the one fabric part having the open part formed therein.

6. The method for knitting a knitted fabric according to claim 1, wherein loops of the wales to be moved in the step (c) are formed by feeding yarn in a direction in which twist in the loops caused by loop transfer is released, in order to prevent occurrence of twisted loops of the wales.

7. A method for knitting a knitted fabric comprising a front fabric part, a back fabric part, an open part, and right and left marginal parts extending along the open part by using a flat knitting machine comprising at least a pair of front and back needle beds, each of which has a large number of needles and at least either of which can be racked laterally to receive and transfer loop between the needle beds, wherein the knitted fabric is knitted in the state in which the front fabric part and the back fabric part are joined to each other at lateral ends of the fabric with respect to knitting width and either of the front fabric part and the back fabric part is split into right and left parts at some midpoint of the knitting width, so that the open part is formed to extend vertically from the splitting place and also the right and left marginal parts comprising an adequate number of wales extending along the open part are arranged in two layers to overlap each other at knit-up positions thereof, the method comprising:

(a) the step of performing a course knitting in the state in which the number of wales of at least one of the right and left split parts of one fabric part having the open part formed at a lateral end thereof with respect to knitting width, which is determined in dependence on the number of wales of the marginal part continuous to the fabric part retained and knitted on the opposite needle bed, are previously sent round to the other fabric part retained and knitted on an opposite needle bed, in order that the-one fabric part is retained on one needle bed and knitted in the state in which the right and left marginal parts are arranged in line with each other, (b) the step of moving the wales to an outside of the one fabric part having the open part formed therein, while the wales as were previously sent round to the opposite needle bed in the step (a) are racked one stitch by one stitch, (c) the step of moving the one fabric part toward the right and left marginal parts to overlap each other by loop transfer; and also performing re-arrangement of loop for a next course knitting by the loop transfer, and (d) the step of connecting together the front fabric part and the back fabric part at lateral ends thereof with respect to knitting width after the step (c) and then knitting courses to form an entire knitted fabric into a completely tubular body.

8. A knitted fabric produced by the method of claim 1.

* * * * *